US007967649B2

(12) United States Patent
Richter et al.

(10) Patent No.: US 7,967,649 B2
(45) Date of Patent: Jun. 28, 2011

(54) ELECTRICAL CONTACT WITH WIRE CLAMP

(75) Inventors: Michael Richter, Schalksmuehle (DE); Bernd Baumunk, Kierspe (DE)

(73) Assignee: Lumberg Connect GmbH, Schalksmuehle (DE)

( * ) Notice: Subject to any disclaimer, the term of this patent is extended or adjusted under 35 U.S.C. 154(b) by 33 days.

(21) Appl. No.: 12/471,631

(22) Filed: May 26, 2009

(65) Prior Publication Data

US 2009/0291601 A1 Nov. 26, 2009

(30) Foreign Application Priority Data

May 24, 2008 (DE) ..... 10 2008 025 016
May 24, 2008 (DE) ..... 10 2008 025 017

(51) Int. Cl.
*H01R 4/10* (2006.01)

(52) U.S. Cl. ..... 439/877; 174/84 C

(58) Field of Classification Search ..... 439/877, 439/882, 421, 442; 174/84 C; 29/863
See application file for complete search history.

(56) References Cited

U.S. PATENT DOCUMENTS

| | | | | | |
|---|---|---|---|---|---|
| 2,965,699 | A | * | 12/1960 | Wayne | 174/84 C |
| 3,125,706 | A | * | 3/1964 | Long | 361/772 |
| 3,594,704 | A | * | 7/1971 | Fischer | 439/421 |
| 3,697,926 | A | * | 10/1972 | Krafthefer | 439/75 |
| 3,699,328 | A | * | 10/1972 | Murray | 362/362 |
| 3,916,139 | A | * | 10/1975 | Schantz | 219/85.22 |
| 4,442,316 | A | * | 4/1984 | Thuermer | 174/84 C |
| 4,753,609 | A | * | 6/1988 | Pfeffer et al. | 439/541 |
| 4,938,709 | A | * | 7/1990 | Smith et al. | 439/239 |
| 4,948,382 | A | * | 8/1990 | Marpoe et al. | 439/406 |
| 6,893,274 | B2 | * | 5/2005 | Chen et al. | 439/106 |
| 7,650,914 | B2 | * | 1/2010 | Bogursky et al. | 140/105 |

FOREIGN PATENT DOCUMENTS

| | | |
|---|---|---|
| DE | 3700304 | 7/1988 |
| DE | 19601408 | 7/1997 |
| DE | 10061533 | 6/2002 |
| EP | 0634810 | 1/1995 |

* cited by examiner

*Primary Examiner* — Neil Abrams
(74) *Attorney, Agent, or Firm* — Andrew Wilford

(57) ABSTRACT

A contact for connecting a wire to a terminal has a contact part engageable with the terminal and defining a main plane, and a wire part formed unitarily with the contact part and forming in an open position a seat offset from the plane and adapted to receive the wire and lying in a closed position coplanar with the contact part.

7 Claims, 3 Drawing Sheets

ELECTRICAL CONTACT WITH WIRE CLAMP

FIELD OF THE INVENTION

The present invention relates to a contact. More particularly this invention concerns a contact for connecting a cellphone microphone or speaker coil wire or lead to a terminal of a printed circuit.

BACKGROUND OF THE INVENTION

A typical such contact is used for connecting a coil wire of a loudspeaker and/or microphone of a cellular phone. It has a wire part with a contact surface to which a wire can be fitted for electrical connection to the contact in an open position and that holds the wire in an electrically contacting way in the closed position.

Such a contact is known in the art from, for example, EP 0,634,810, DE 196 01 408, DE 10 061 533, and DE 3,700, 304. The contact is essentially made of sheet metal bent into a V-shape. In the open position of the two contact arms, the wire, in particular a coil wire, is fitted between the two arms. Then the two arms are bent together to grip the wire. Welding or soldering fixes the two arms and the gripped wire together.

For quite a while now, cellular communication devices, particularly cellular phones, are continuously made smaller, while the number of functions they perform is increased. This poses a continuous necessity for decreasing the size.

OBJECTS OF THE INVENTION

It is therefore an object of the present invention to provide an improved contact.

Another object is the provision of such an improved contact that overcomes the above-given disadvantages, in particular that is particularly compact.

A further object is to provide such a contact that can be made at very low cost, and that is very easy to use.

Yet another object is to provide an improved method of connecting a wire to a contact.

SUMMARY OF THE INVENTION

A contact for connecting a wire to a terminal has according to the invention a contact part engageable with the terminal and defining a main plane, and a wire part formed unitarily with the contact part and forming in an open position a seat offset from the plane and adapted to receive the wire and lying in a closed position coplanar with the contact part.

The connecting section forms for the wire in the open position a seat that is offset at least by the thickness of the wire gauge from the main plane of the connecting section. Thus the contact has a physical height constituted by the addition of the material thickness of the connecting section, the thickness of the material forming the seat and the distance between seat and wire part. The spacing corresponds to at least the wire gauge.

In the prior art, the height of the contact in the closed position corresponds to the thickness of the first arm plus the thickness of the second arm and the gauge/diameter of the wire between them. In the open position, the contact according to the invention thus comprises the same physical height as the prior used contact in the closed position.

The considerable advantage of the contact according to the invention can be found in the closed position thereof. The seat holding the wire is in the main plane of the connecting section. Thus the physical height of the contact according to the invention is reduced by the thickness of the material forming the seat. The contact according to the invention is thus flatter than the prior used contact, thus minimizing the necessary physical space necessary to accommodate it.

For clarification purposes, specific material thicknesses are mentioned here as an example. Usually, the sheet metal forming the contact in the state of the art and also the contact according to the invention has a thickness of approximately 0.1 mm. The wire comprises a diameter of approximately 0.07 mm that is negligible. The contact thickness of the contact according to the invention is thus almost halved in the closed position.

In a preferred embodiment, the seat is formed by a web made of a sheet metal, forming the connecting section of the contact.

In a particularly preferred embodiment, the web is formed by punching two slits that are parallel to each other from a sheet-metal blank. The web thus created is then plastically deformed to make a seat passage in the open position of the contact.

A particularly preferred embodiment is characterized in that the width of the slit approximately corresponds to the gauge of the wire, preferably somewhat less. This has the substantial advantage that the wire is clamped in at least one of the slits and forms a very good electrical connection.

From the state of the art described above and the requirements regarding decreasing the size of components in cellular communication devices, particularly in cellular phones, a further object of the invention is to provide a method for connecting a wire to a contact that allows for a contact to be built as compact as possible. Such a method serves for connecting a wire, particularly a coil wire of a loudspeaker and/or microphone of a cellular phone to a contact with a substantially sheet metal like wire part The method comprises the steps of first punching from a planar flat sheet metal blank a pair of generally parallel slits to form a bridge and punching the blank to form an elongated spring tongue. Then the blank is plastically deformed such that the web and the tongue both project out of the plane of the blank, thereby forming with the web a seat passage open generally parallel to the blank. A wire is inserted into the passage, and then the web is plastically deformed back into the plane of the blank. This action deforms the wire such that it passes through both of the slits and over the web and is gripped in the slits. Then the blank against a conductor with elastic deformation of the spring tongue back toward the plane of the blank.

The essential advantage of the method according to the invention can be seen in that the contact height substantially only corresponds to the thickness of the material of the contact.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
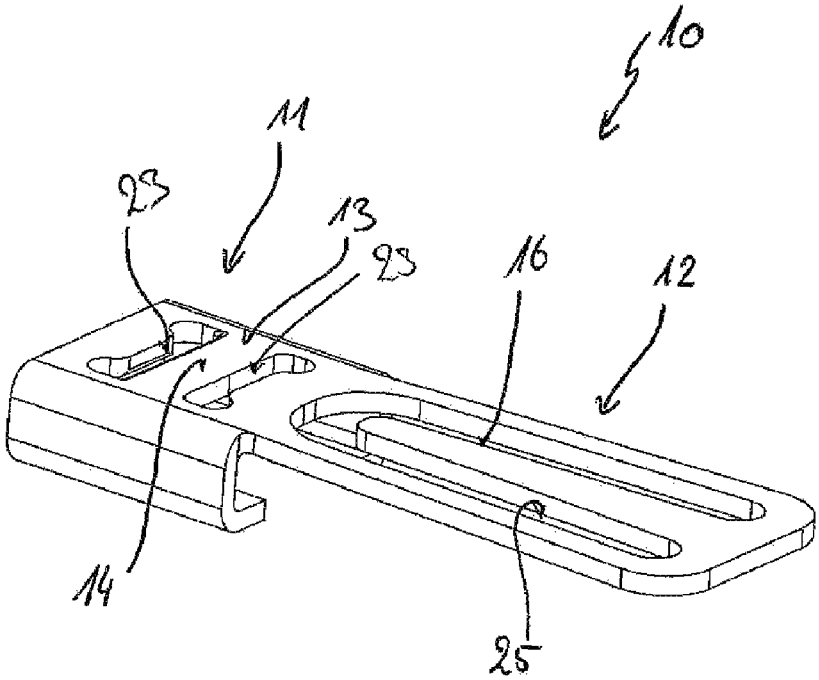

As seen in the drawing, a contact 10 basically has a wire part 11 and a contact part 12. The wire part 11 serves for receiving and electrically connecting to a coil wire of a microphone and/or a loudspeaker of a cellular phone. The wire part 11 comprises a web 13 that forms a contact surface 14 (FIG. 2). The contact part 12 serves for contacting another contact or terminal, in particular a contact pad of a circuit board that carries electronic components of a mobile communication device, particularly of a cellular phone. To this end, the contact part 12 comprises a spring 15 in the shape of a tongue 16. The contact 10 is formed from a single piece of sheet metal by punching and bending.

Figure 3:
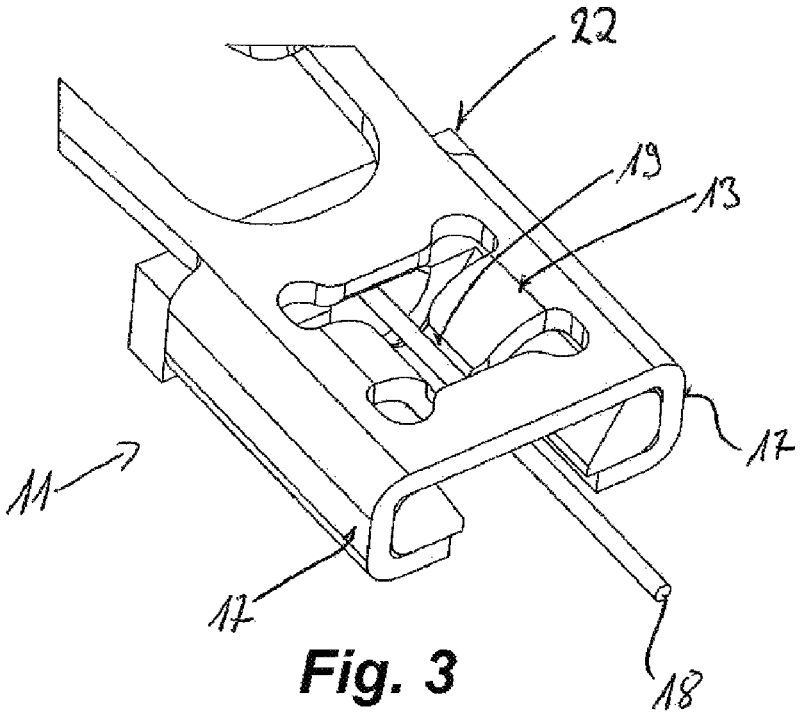
FIGS. 3 and 4 are large-scale partial perspective views of the wire part of the contact in the open and closed positions, respectively.
Figure 4:
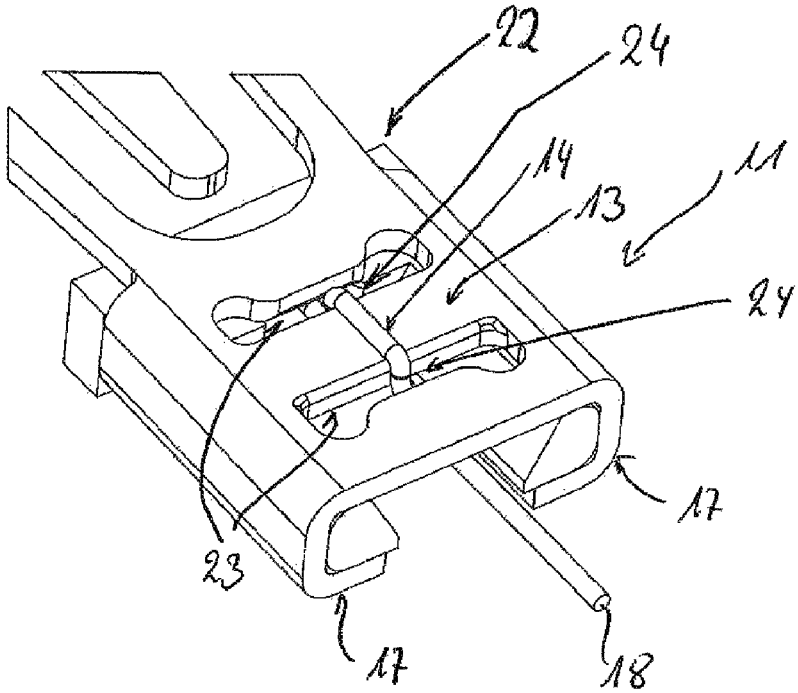

For attaching the contact 10 to a cellular phone, as for example a support 22 (FIGS. 3 and 4) provided on the phone's housing, the wire part 11 is formed at its edges with two confronting and parallel C-section rails 17. The support block 22 can fit into these rails 17 as shown in FIGS. 3 and 4. The wire part 11 and the contact part 12 lie in the same plane $E_1$ (FIG. 5).

Figure 1:
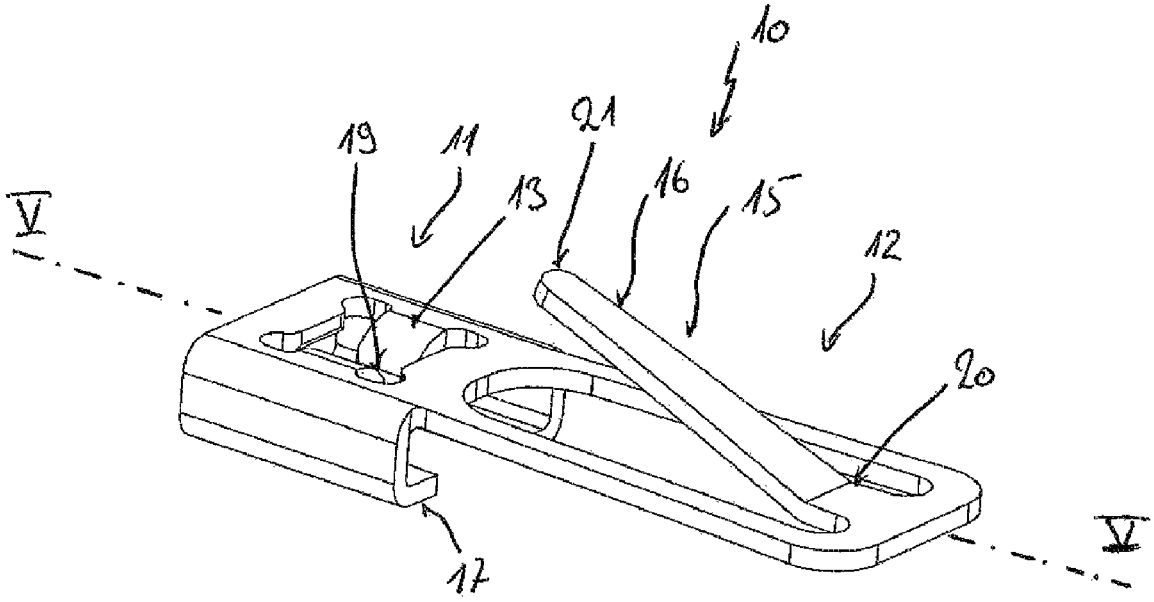
FIGS. 1 and 2 are perspective views of the contact according to the invention in the open and closed position, without a wire.
Figure 5:
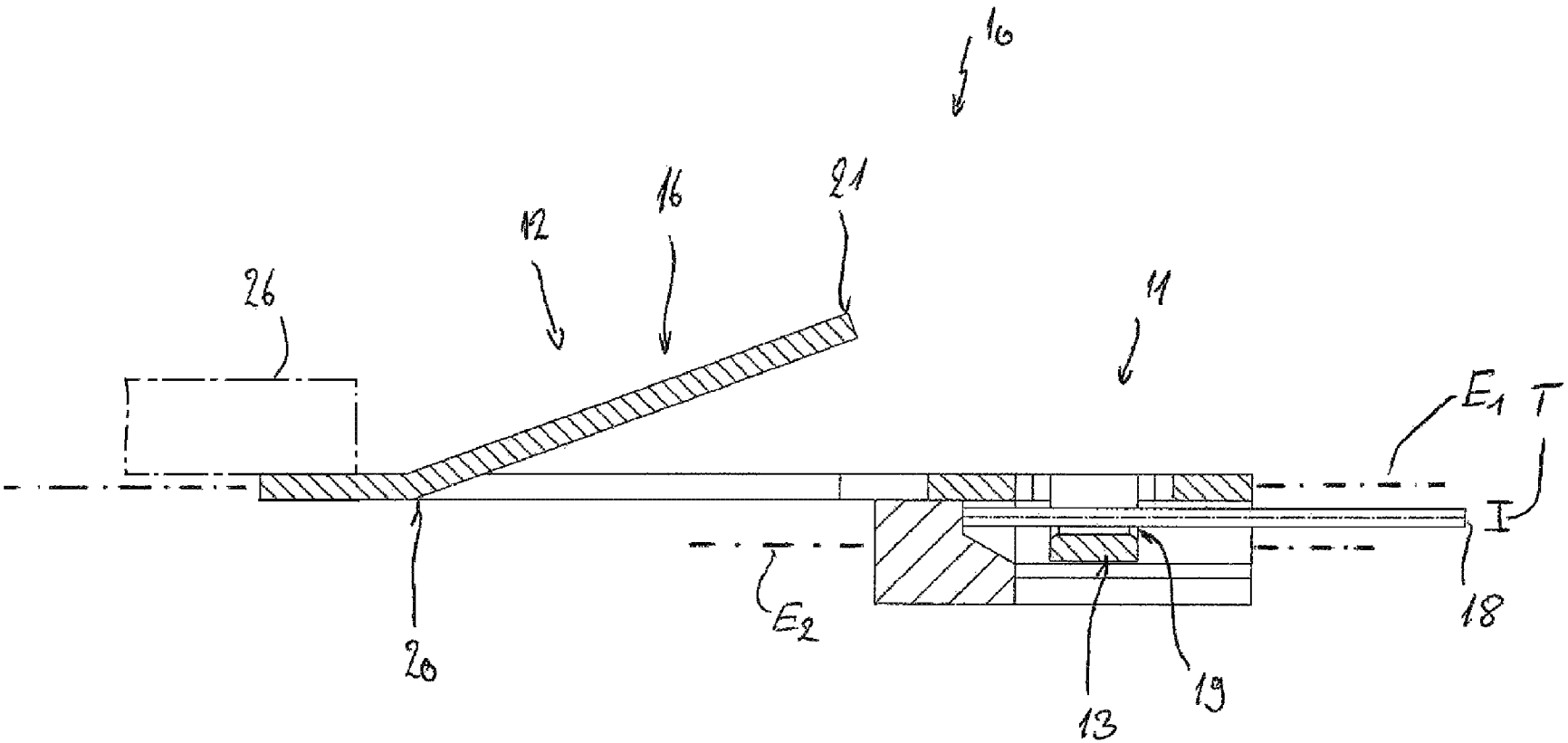
FIG. 5 is a side view of the contact in the open position, fitted to a support and with a wire inserted in it.

In FIG. 1 the contact 10 is shown in its open position that corresponds to its original condition with no permanent connection between the wire 18 and the contact surface 14 (see FIG. 3 to 5) or between contact part 12 and the contact field on a printed-circuit board shown schematically at 26 in FIG. 5. In this open position the web 13 is deformed out of the plane $E_1$, preferably downward and forms a passage or seat 19 with the contact surface 14 that supports the wire 18. A passage width T perpendicular to the plane $E_1$ of this design corresponds to at least the diameter of the wire 18 (FIGS. 3, 4, and 5). Due to this design, the web 13 forming the passage 19 in the open position of the contact lies in a plane $E_2$ spaced at least the passage width T from the main plane $E_1$ of the wire part 11.

In the open position of the contact 10 shown in FIG. 1 the spring tongue 16 of the contact part extends upward from the contact at a small acute angle of about 20°. The spring tongue end 21 located opposite of the tongue base 20 is arranged considerably above the main plane $E_1$ of the wire part 11.

In the open position of the contact the physical height of the wire part 11 and contact part 12 is considerably larger than the thickness of the sheet metal from which the contact 10 is formed due to the design of the web 13 and the angle of the spring tongue 16.

The situation is completely different in the closed position of the contact according to FIG. 2. In that position, the web 13 and the spring tongue 16 all lie in the main plane $E_1$, so that the physical height of the wire part 11 and contact part 12 essentially correspond to the material thickness of the sheet metal from which the contact 10 is formed, not counting the C-section rails 17. The connection of the circuit board 26 to the contact part 12 can be easily imagined. The connection due to pressure is created by the contact part 12 of the contact 10 being moved in the direction of the circuit board 26 until it lies flat on the circuit board 26.

The connection of the wire 18 to the wire part 11 is shown in FIGS. 3 and 4. In FIG. 3, the wire part 11 is in the open position, so that the wire 18 can be inserted into the passage seat 19. In the closed position (FIG. 4) the web 13 is reshaped in such a way that is lies in the main plane $E_1$ of the wire part 11. The wire 18 then lies above the main plane $E_1$ on the contact surface 14.

The web 13 is formed by providing the sheet metal with two parallel slits 23 (see FIG. 2). The slits 23 are at least in a central clamping region 24 of the web 13 not wider than the diameter of the wire 18 to be contacted (see FIG. 4). When the web 13 is reshaped into the main plane $E_1$, the wire 18 is positioned in the shape of a bridge over the web 13. In the clamping region 24, the wire 18 is clamped and contacted due to the slit width. After the closing process of the wire part 11, the wire 18 can also be fixed by welding or soldering to the web 13. Secure electric contacting of the coil wire 18 on the wire part 11 is preferably carried out by the plastic reshaping of the web 13 only. The cutting edges of the web 13 in the clamping region 24 thus serve mainly as contact surfaces on the contact side.

As can be seen in FIG. 2 in particular, the spring tongue 16 is formed by cutting a U or V-shaped stamped slit into the sheet metal. Altogether, the contact 10 is a stamped and bent part made of sheet metal and can thus be extremely easily, cost effectively and efficiently produced.

The considerable advantage of the contact 10 according to the invention is that the wire part 11 and the contact part 12 correspond in their physical height to the thickness of the contact 10 in the closed state. The prior systems using two layers of material that connect to the wire by insertion of the wire between two layers, comprises in comparison a physical height of at least double the thickness.

From the above description of the drawings and the figures, a method for the production of a contact, particularly a method for connecting a wire 18 to a contact 10 can furthermore be derived.

First a planar contact blank is punched from a suitable sheet metal, the web 13 being formed by cutting the slits 23 and the spring tongue 18 by cutting an essentially V- or U-shaped hole 25.

Then the support rails 17 are formed by plastic deformation of the parallel longitudinal edges of the blank, the web 13 is bent down to the plane $E_2$, and the spring tongue 16 is bent up and angled from the main plane $E_1$. The contact is now in the open position. For connecting the wire 18 to the wire part 11, the wire 18 is inserted into the passage seat 19 formed between the web 13 and the flanking regions of the wire part 11. Then the web 13 is plastically reshaped in such a way that it lies again in the main plane $E_1$ of the wire part 11, which reshaping causes the wire 18 to span over the web 13. Because of the narrow slits 23 in the sheet metal of the contact 10, that correspond approximately to the diameter of the wire 18, the wire 18 is pinched and in fact the metal of the part 11 even bits into the wire 18, making an excellent contact therewith while solidly anchoring it to the contact 10.

The above-described contact 10 is a push-type contact because of the contact part 12 thereof. Thus, a push-type contact, particularly for contacting a coil wire of a microphone and/or loudspeaker of a cellular phone to a circuit board is provided, having a wire part that grips a wire 18 so as to form a good electrical connection therewith and a contact part comprising a spring capable of making another good electrical connection, typically with a trace of a circuit board 26.

Generic push-type contacts are available in multiple shapes, in most cases the spring of the contact part is formed of a sheet metal section angled from a sheet metal plane. A contact button of the spring serves for contacting for example a contact pad of a circuit board.

A push-type contact is shown, particularly for connecting a coil wire of a microphone and/or loudspeaker of a cellular phone to a circuit board, with a wire part where a wire is engaged for a good electrical connection with a contact part comprising a spring in good electrical contact with a contact pad, characterized in that the push-type contact lies mainly in a main plane in which the pressure section is arranged and that the spring of the contact part is angled from the main plane of the pressure section in the contact free state and is arranged in the main plane of the pressure section in the contacted state.

The important advantage of the push-type contact is the physical height of the contact part. No elements exist in the contacted states that are arranged outside of the main plane. The spring can be designed without a contact button.

For clarification purposes, specific material thicknesses are mentioned here as an example. Usually, the sheet metal forming the contact in the state of the art and also the contact according to the invention has a thickness of approximately 0.1 mm. The wire has a diameter of approximately 0.07 mm. The contact thickness of the contact according to the invention is thus almost halved in the closed position.

It is specifically intended that the physical height of the contact part when connected essentially correspond to the thickness of the material from which the contact part is made.

With this embodiment, the pressure section is designed in the shape of a paper clip as far as the spring is concerned. When angling the spring from the main plane it can happen that the contact part is deformed in the region of the tongue base. The substantial advantage of this example of an embodiment is that the deformation of the contact part is in direct relation to the angling of the spring tongue which is reversed when the spring tongue is moved back.

Thus, the figures show a push-type contact, particularly for connecting a wire coil of a microphone and/or loudspeaker of a cellular phone to a circuit board, with a wire part whereon a wire is arranged in an electrically conductive way and with a contact part, comprising a spring being in a pressure connection with a contact filed, characterized in that the push-type contact comprises a main plane, wherein the contact part is arranged and that the spring of the pressure section is angled in the contact free state from the main plane and is arranged in the main plane of the pressure section in the contacted state.

We claim:

1. A contact comprising:

a wire part formed of sheet metal, lying completely on and defining a main plane, and formed with two spaced throughgoing slits of a predetermined width and defining a web, the web being deformed into an open position out of the main plane and defining a seat passage adapted to receive a wire and open parallel to the main plane, the web being plastically deformable when the wire is in the seat into a closed position lying completely in the main plane with the wire passing through both slits and being pinched on opposite sides of the web, the wire part being formed with support rails extending parallel to each other, flanking the slots and tongue, and extending down out of the main plane; and a contact part formed unitarily of the sheet metal with the wire part and lying completely in the main plane, the contact part having a V- or U-shaped throughgoing hole defining a spring tongue lying completely in the main plane in the closed position and projecting at an acute angle out of the main plane in the open position.

2. The contact defined in claim 1 wherein the slits are of a width generally equal at most to a diameter of the wire.

3. The contact defined in claim 2 wherein the slit width is smaller than the wire diameter.

4. The contact defined in claim 1 wherein the web in the open position projects from the main plane to the same side as the rails, the wire engaging a face of the web turned away from the rails.

5. The contact defined in claim 4 wherein the wire engages a face of the wire part opposite the face of the web engaged by the wire.

6. The contact defined in claim 1 wherein the slits are of identical width.

7. The contact defined in claim 1 wherein the tongue is elastically deformable between the open and closed positions and when unstressed is in the open position projecting at the angle from the main plane.

* * * * *